United States Patent [19]

Smith

[11] 4,394,133

[45] Jul. 19, 1983

[54] ALKYL ACETATES AS PHASE SEPARATION INHIBITORS IN LIQUID HYDROCARBON FUEL AND ETHANOL MIXTURES

[75] Inventor: Harry A. Smith, Midland, Mich.

[73] Assignee: The Dow Chemical Company, Midland, Mich.

[21] Appl. No.: 353,135

[22] Filed: Mar. 1, 1982

[51] Int. Cl.[3] ..... C10L 1/18

[52] U.S. Cl. ..... 44/56; 44/70

[58] Field of Search ..... 44/56, 70

[56] References Cited

U.S. PATENT DOCUMENTS 1,423,058 7/1922 Whitaker ..... 44/56

OTHER PUBLICATIONS

Noikov, Chem. Abstr., 1977, 86:158133f.

*Primary Examiner*—Charles F. Warren
*Assistant Examiner*—Y. Harris-Smith
*Attorney, Agent, or Firm*—Norman L. Sims; Douglas N. Deline

[57] ABSTRACT

This invention is a method of preventing phase separation of hydrous ethanol and liquid hydrocarbon fuel mixtures comprising the addition of an effective amount of a phase separation inhibitor selected from the group of alkyl acetates which have:

(a) a solubility parameter of about 8.4 to 9.8 $(cal/cc)^{\frac{1}{2}}$; and (b) a dipole moment of about 1.75 to 1.90 debye.

15 Claims, No Drawings

ALKYL ACETATES AS PHASE SEPARATION INHIBITORS IN LIQUID HYDROCARBON FUEL AND ETHANOL MIXTURES

BACKGROUND OF THE INVENTION

This invention relates to novel fuel mixtures for use in engines which use liquid hydrocarbon fuels and to novel processes to prevent phase separation in liquid hydrocarbon fuel and hydrous ethanol mixtures. More particularly, the invention relates to solubilizing ethanol which contains water in liquid hydrocarbon fuels, including gasoline, by means of additives which have no adverse effect on storage, stability, water-shedding or corrosion properties.

The use of commercial ethanol in liquid hydrocarbon fuels such as in gasoline blends commonly referred to as "gasohol", can cause a phase separation problem because of the limited solubility of water/ethanol mixtures in liquid hydrocarbons, particularly in low aromatic content gasolines.

A major cause of this problem is the tendency of ethanol to absorb water. Additionally, industrial grade ethanol commonly used in gasohol contains about 5 percent by weight of water. The water causes the ethanol in liquid hydrocarbon fuel mixtures to separate into a second phase, particularly at low temperatures. This phase separation may also result in corrosion problems and poor combustion performance in the engine.

The literature discloses compositions which solubilize hydrous ethanol in the gasoline. Such compositions include alkyl t-butyl ethers such as methyl t-butyl ether, ethyl t-butyl ether and higher molecular weight distillation bottoms disclosed by U.S. Pat. Nos. 4,207,077 and 4,207,076, respectively.

One of the principal objects of this invention is to provide an improved liquid hydrocarbon fuel composition wherein the liquid hydrocarbon and ethanol components are maintained in a single phase by a phase separation inhibitor.

Another object is to provide a phase separation inhibitor for liquid hydrocarbon fuel and hydrous ethanol mixtures which is effective at very low weight percentages and is economical to use. A further object is to inhibit this separation at temperatures as low as −40° C. to allow the effective use of liquid hydrocarbon fuel and hydrous ethanol mixtures in cold climates such as the northern United States.

SUMMARY OF THE INVENTION

This invention is a method of preventing the phase separation of hydrous ethanol and liquid hydrocarbon fuel mixtures comprising adding to the solution an effective amount of a phase separation inhibitor selected from the group of alkyl acetates which have:

(a) a solubility parameter of about 8.4 to 9.8 $(cal/cc)^{\frac{1}{2}}$; and (b) a dipole moment of about 1.75 to 1.90 debye.

The invention is further a gasohol composition in which phase separation is inhibited comprising gasohol and an effective amount of a phase separation inhibitor selected from the group of alkyl acetates defined above.

DETAILED DESCRIPTION OF THE INVENTION

It has been discovered that alkyl acetates which have both a solubility parameter between about 8.4 and 9.8 $(cal/cc)^{\frac{1}{2}}$ and a dipole moment between about 1.75 and 1.90 debye exhibit good phase separation inhibition characteristics in liquid hydrocarbon fuel and hydrous ethanol mixtures. The solubility parameter is defined by Harry Burrell in his article "Solubility Parameters" *Interchemical Review,* 14(1), 3 (1955), incorporated herein by reference.

A method for inhibiting phase separation in a mixture of a liquid hydrocarbon fuel and hydrous ethanol comprises contacting the mixture with an effective amount of a phase separation inhibitor selected from the group of alkyl acetates which have a solubility parameter between about 8.4 and 9.8 $(cal/cc)^{\frac{1}{2}}$; and a dipole moment between about 1.75 and 1.90 debye.

Preferred alkyl acetates are straight and branched chain $C_{1-6}$ alkyl acetates. More preferred alkyl acetates are straight chain $C_{2-4}$ alkyl acetates. The most preferred alkyl acetate is ethyl acetate.

Liquid hydrocarbon fuel shall mean herein hydrocarbon distillates distillable at atmospheric pressure where the 90 percent point is about 675° F. or less, preferably about 640° F. or less. Most preferably the 90 percent evaporated endpoint is about 400° F. or less. Examples of these liquid hydrocarbon fuels include aviation gasolines, motor gasolines, diesel fuel oils, aviation turbine fuels, gas-turbine fuel oils, farm tractor fuels, etc. These terms are defined in *Kirk-Othmer Encyclopedia of Chemical Technology,* 2nd Ed., Vol. 15, pp. 77–92, "Petroleum Products", incorporated herein by reference. The preferred liquid hydrocarbon fuels are those having a utility as fuel in internal combustion engines, most preferable are motor gasolines.

A liquid hydrocarbon fuel commonly mixed with hydrous ethanol is automotive gasoline. The mixture of automotive gasolines and hydrous ethanol is commonly known as gasohol. The gasoline content is usually between 80 and 99 percent by weight with a hydrous ethanol content between about 1 and 20 percent. The ethanol, by the time of ultimate use, has about 5 percent by weight of water in it due to its water absorptive characteristics, but it could have as much as or even more than 12 percent water and is therefore referred to as hydrous ethanol. Preferred according to the invention is gasohol comprising about 90 percent by weight of gasoline and 10 percent by weight of hydrous ethanol, which comprises about 95 percent by weight of ethanol and 5 percent by weight of water.

The amount of the phase separation inhibitor which is needed for effective inhibition is dependent upon the percentage of water in the liquid hydrocarbon fuel and hydrous ethanol mixture. As the percentage of water present increases, the amount of inhibitor required for effective phase separation inhibition increases. The amount of inhibitor required is also dependent upon the temperature to which the liquid hydrocarbon fuel and hydrous ethanol mixture will be subjected. As the temperature decreases, more inhibitor is required to prevent phase separation.

It is preferable that the phase separation inhibitor be effective at 0° C., more preferable that it be effective at −20° C., and most preferable that it be effective at −40° C.

Further, the amount of inhibitor required to prevent phase separation depends upon the effectiveness of the particular inhibitor used. An effective amount of inhibitor is preferably between 0.05 and 10.0 percent by weight of liquid hydrocarbon fuel and hydrous ethanol mixture and is most preferably between 0.1 and 1.0 percent by weight of the liquid hydrocarbon fuel and hydrous ethanol mixture.

Table I gives examples of alkyl acetates which are suitable phase separation inhibitors and their solubility parameters and dipole moments.

TABLE I

| Compound | Solubility Parameter (debye) | Dipole Moment (cal/cc)$^{\frac{1}{2}}$ |
|---|---|---|
| 1. Ethyl acetate | 9.1 | 1.78 |
| 2. Isopropyl acetate | 8.4 | 1.77 |
| 3. Butyl acetate | 8.5 | 1.77 |

EXAMPLE 1

Three different acetates were dissolved in commercially available gasohol (90 percent gasoline, 9.59 percent ethanol, 0.41 percent water) at the concentrations of 0.4 percent and 0.1 percent by weight of the gasohol. The lowest temperature at which the sample would remain in one phase was determined. The results are compiled in Table II.

TABLE II

| | Lowest temperature for 1 phase | |
|---|---|---|
| Compound | 0.4% Concentration | 0.1% Concentration |
| 1. Ethyl acetate | Below −40° C. | Below −40° C. |
| 2. Isopropyl acetate | −30° C. | Above −30° C. |
| 3. Butyl acetate | −40° C. | Above −40° C. |

EXAMPLE 2

A commercially obtained gasohol composition, 90 percent gasoline, 9.59 percent ethanol and 0.41 percent water, was examined for phase separation at reduced temperatures. Phase separation occurred between −10° C. and −20° C.

What is claimed is:

1. A method for preventing a mixture of hydrous ethanol and a liquid hydrocarbon fuel from separating into two phases comprising adding to the mixture an effective amount less than about 1 percent by weight of the liquid hydrocarbon fuel and hydrous ethanol of a phase separation inhibitor wherein the inhibitor is selected from the group of alkyl acetates which have:

(a) a solubility parameter of about 8.4 to 9.8 (cal/cc)$^{\frac{1}{2}}$; and (b) a dipole moment of about 1.75 to 1.90 debye.

2. The method of claim 1 wherein the amount of phase separation inhibitor added is between about 0.1 and about 1.0 percent by weight of hydrocarbon fuel and hydrous ethanol mixture.

3. The method of claim 1 wherein the alkylacetate phase separation inhibitor is selected from the group consisting of straight or branched chain $C_{1-6}$ alkyl acetates.

4. The method of claim 3 wherein the phase separation inhibitor is selected from the group consisting of straight chain $C_{2-4}$ alkyl acetates.

5. The method of claim 4 wherein the phase separation inhibitor is ethyl acetate.

6. The method of claim 1 wherein the liquid hydrocarbon fuel has utility as a fuel for an internal combustion engine.

7. The method of claim 6 wherein the liquid hydrocarbon fuel is gasoline.

8. The method of claim 1 wherein the phase separation inhibitor is effective above about 0° C.

9. The method of claim 1 wherein the phase separation inhibitor is effective above a temperature of about −20° C.

10. The method of claim 1 wherein the phase separation inhibitor is effective above a temperature of about −40° C.

11. A gasohol composition in which phase separation is inhibited comprising gasohol having added thereto an effective amount less than about 1 percent by weight of the gasohol, of an alkyl acetate phase separation inhibitor wherein the inhibitor is selected from the group of alkyl acetates which have:

(a) a solubility parameter of about 8.4 to 9.8 (cal/cc)$^{\frac{1}{2}}$; and (b) a dipole moment of about 1.75 to 1.90 debye.

12. The composition of claim 11 wherein the amount of alkyl acetate phase separation inhibitor added is from about 0.1 to about 1.0 percent by weight of the gasohol.

13. The composition of claim 11 or 12 wherein the gasohol comprises between about 80 percent and 99 percent by weight gasoline and between about 1 percent and 20 percent by weight hydrous ethanol.

14. The composition of claim 13 wherein the gasohol comprises about 90 percent by weight gasoline and about 10 percent by weight hydrous ethanol.

15. The composition of claim 14 wherein the hydrous ethanol comprises about 95 percent by weight ethanol and about 5 percent by weight water.

* * * * *